United States Patent [19]

Lawless et al.

[11] Patent Number: 4,918,421

[45] Date of Patent: Apr. 17, 1990

[54] NONLINEAR RESISTOR FOR LOW TEMPERATURE OPERATION

[76] Inventors: William N. Lawless; Tapan K. Gupta, both c/o CeramPhysics, Inc., 921 Eastwind Dr., Ste. 110, Westerville, Ohio 43081

[21] Appl. No.: 841,602

[22] Filed: Mar. 20, 1986

[51] Int. Cl.[4] ..... H01C 7/10

[52] U.S. Cl. ..... 338/21; 29/612

[58] Field of Search ..... 338/21, 20, 314; 252/521, 517, 518; 29/612

[56] References Cited

U.S. PATENT DOCUMENTS

| | | | |
|---|---|---|---|
| 4,038,217 | 7/1977 | Namba et al. | 252/521 |
| 4,041,436 | 8/1977 | Kouchich et al. | 338/21 |
| 4,094,061 | 6/1978 | Gupta et al. | 29/612 |
| 4,169,071 | 9/1979 | Eda et al. | 252/517 |
| 4,198,443 | 4/1980 | Pitha | 427/321 |
| 4,290,041 | 9/1981 | Utsumi et al. | 338/21 |
| 4,452,728 | 6/1984 | Carlson et al. | 252/518 |
| 4,452,729 | 6/1954 | Carlson et al. | 252/518 |
| 4,460,497 | 7/1984 | Gupta et al. | 252/518 |

OTHER PUBLICATIONS

Levinson et al, The Physics of Metal Oxide Varistors, 46, J. Appl. Phys., 1332 (1975).

Philipp et al, Low-Temperature Electrical Studies on Metal-Oxide Varistors-A Clue to Conduction Mechanisms, 48, Appl. Phys., 1621 (1977).

Mahan et al, Theory of Conduction in ZnO Varistors, 50, J. Appl. Phys., 2799 (1979).

*Primary Examiner*—Teresa J. Walberg

*Assistant Examiner*—M. M. Lateef

*Attorney, Agent, or Firm*—Killworth, Gottman, Hagan & Schaeff

[57] ABSTRACT

A nonlinear resistor which exhibits substantial temperature independence over a wide range of temperatures, including low temperatures, is provided. The resistor is formed of a zinc oxide-based ceramic composition which exhibits nonlinear voltage/current characteristics and is essentially unafffected by magnetic fields. The nonlinear resistor provides protection for electrical devices in a circuit from voltage surges and/or transients. In a preferred form, the resistor is manufactured as a multilayer capacitor-type device.

18 Claims, 2 Drawing Sheets

NONLINEAR RESISTOR FOR LOW TEMPERATURE OPERATION

BACKGROUND OF THE INVENTION

This invention relates to a ceramic device which exhibits nonlinear voltage characteristics over a wide range of temperatures including low temperatures, and more particularly to a zinc oxide-based ceramic varistor for protecting electrical devices from voltage surges and/or transients.

In recent years, the use of large scale superconducting magnets has grown so that such devices now are finding application in particle accelerators, nuclear magnetic resonance (NMR) body-scanning systems, magnetohydrodynamic power generation, and controlled thermonuclear fusion by magnetic field containment, for example. These superconducting magnets are operated at liquid helium temperatures (4.2 K.). Such superconducting magnets are subject to voltage surges and disturbances, principally during start up operations when the magnets are up-ramped. Such disturbances take the form of point disturbances and distributed transient disturbances, the latter representing the more serious instability problem.

When such disturbances occur, the magnet might be quenched. Quenching results in the immediate vaporization of a large quantity of costly liquid helium with the attendant possibility of asphyxiation as well as resultant down time for the system. To avoid the need for quenching, elaborate and costly quench management systems have been devised which typically employ diodes in various configurations to "dump" the conductor current when the voltage rises above a certain level, i.e., when a transient or voltage surge occurs. Two diodes in parallel are often used to avoid polarity problems. Although these diodes operate at helium temperatures, they are quite large (e.g. 3 inches in diameter) in order to handle the dump current. This large size complicates heat dissipation in the diodes. Additionally, the diodes are preferably located at the fringes of the magnetic field to avoid the adverse effects of intense fields on their ferromagnetic mountings.

Zinc oxide-based compositions have been known and used widely for several years in devices designed to limit voltage surges in electrical circuits. These zinc oxide-based compositions exhibit highly nonlinear voltage/current characteristics such that as a predetermined voltage level is reached, the resistance of the composition drops drastically and permits the passage of very high current densities. The term varistor has been coined to describe the electrical behavior of such compositions and devices made therefrom.

Such zinc oxide-based varistors have been made by mixing zinc oxide with up to 20 percent by weight of other metal oxide additives such as the oxides of bismuth, antimony, cobalt, manganese, nickel, chromium, silicon, etc. and then sintering. During sintering, these metal oxide additives concentrate in the grain boundaries of the ceramic and are widely believed to provide the electrical barriers necessary to impart the nonlinear voltage/current properties. Typically, these zinc oxide-based varistors at low voltages exhibit near insulating properties (the so-called "insulating pre-breakdown region") because of the insulating barriers between grains. However, at higher voltages, the current density through the varistor may increase by up to six orders of magnitude (the so-called "breakdown region"). Finally, at still higher voltages an "upturn region" is reached where nearly linear voltage/current relationships are again found due to the highly conductive zinc oxide grains.

In contrast to other nonlinear devices such as Zener diodes and silicon carbide-based varistors, the breakdown region for zinc oxide-based devices spans a wide range of current densities. However, while these nonlinear properties exist a room temperature, such varistor properties for zinc oxide-based ceramics disappear below room temperature and certainly in the region below about 110 K.

Accordingly, the need exists in the art for a ceramic device which exhibits nonlinear voltage/current characteristics over a wide range of temperatures including low temperatures and which remains relatively unaffected by magnetic fields.

SUMMARY OF THE INVENTION

The present invention meets these needs by providing a zinc oxide-based ceramic device which exhibits nonlinear voltage/current characteristics (i.e., is substantially temperature independent) over a wide range of temperatures including all temperatures below room temperature down to at least 4 K. as well as temperatures above room temperature. The ceramic device is designed to operate primarily at temperatures in the range of from about 4 to about 300 K. The composition used in the ceramic device of the present invention and methods for making the compositin are more fully disclosed in Gupta et al, U.S. Pat. No. 4,460,497, the disclosure of which is hereby incorporated by reference.

Surprisingly, it has been found that this ceramic composition retains its nonlinear voltage/current characteristics at temperatures below room temperature, including the temperature range of from about 4 to about 300 K. This ability to retain varistor characteristics at such low temperatures enables the composition to be used as a nonlinear resistor in electrical devices designed to be operated at very low temperatures. We have coined the term "cryovaristor" to describe this nonlinear resistor device.

Such electrical devices include superconducting magnets which are designed to operate at liquid helium temperatures (4.2 K.). The nonlinear resistor of the present invention may also find use in other electrical devices designed to be operated at liquid oxygen, nitrogen, air, or methane temperatures in the range of 4 to 300 K.

The nonlinear resistor of the present invention may be advantageously placed in an electrical circuit with such an electrical device to prevent a rise in voltage in the circuit above a predetermined level. There, the nonlinear voltage/current characteristics of the ceramic composition are utilized to prevent voltage surges and transients from adversely affecting operation. With respect to use in a quench protection/management circuit in a superconducting magnet, the nonlinear resistor of the present invention has the additional advantage of being substantially unaffected by strong magnetic fields.

In a preferred embodiment of the invention, the nonlinear resistor is fabricated as a multilayer capacitor-type device comprising a plurality of alternating layers of a metal electrode and the ceramic composition. The plurality of alternating layers are electrically connected in parallel so that the dump current may be shared equally across the layers. Devices having several (from 50 to 100) layers are within the scope of the invention. This multiplicity of layers permits the design of nonlinear resistors having relatively smaller sizes with the ability to dissipate heat buildup from the dump current much more readily than the large diodes current used.

Accordingly, it is an object of the present invention to provide a ceramic device which exhibits nonlinear voltage/current characteristics over a wide range of temperatures including low temperatures and which is relatively unaffected by magnetic fields. These and other objects and advantages of the invention will become apparent from the following detailed description, the accompanying drawings, and the appended claims.

DESCRIPTION OF THE PREFERRED EMBODIMENT

Figure 1:
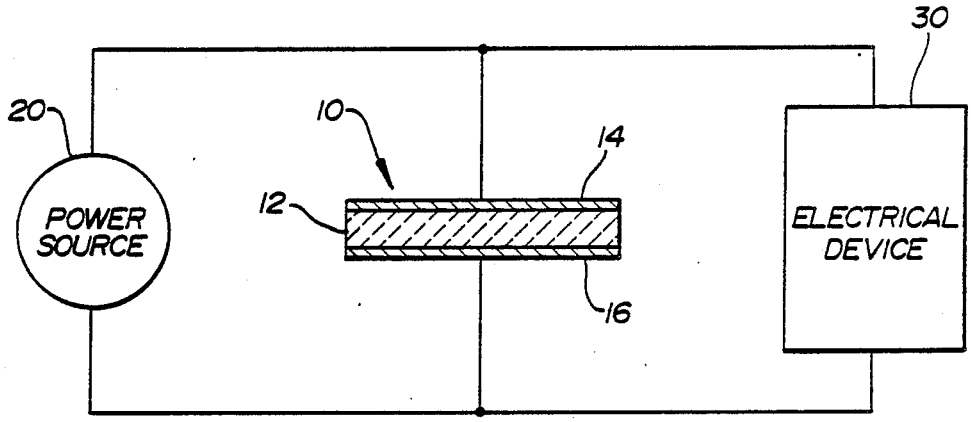
FIG. 1 is a schematic illustration of the nonlinear resistor of the present invention in a simple electrical circuit with an electrical device designed to prevent a voltage rise above a predetermined level.

Referring to FIG. 1, a schematic illustration of the nonlinear resistor of the present invention connected in a typical voltage surge protection circuit is presented. Nonlinear resistor 10 includes a zinc oxide-based ceramic composition 12 sandwiched between two metal electrodes 14 and 16. The nonlinear reactor 10 is electrically connected in parallel with a power source 20 and an electrical device to be protected 30.

Such an electrical device 30 may be any known electrical device which is designed to operate in the temperature range of between 4 to 300 K. This temperature range encompasses operation of devices at liquid helium, nitrogen, oxygen, air and methane temperatures and includes superconducting devices such as superconducting magnets.

The zinc oxide-based ceramic composition which is incorporated into the nonlinear resistor and method of operation of the present invention is taught by Gupta et al, U.S. Pat. No. 4,460,497. That composition includes a major amount of zinc oxide of at least about 90 mole %. It also includes additional metal oxides including from about 0.002 to about 0.002 mole % aluminum oxide and from 0.003 to about 0.2 mole % of at least one other metal oxide selected from the group consisting of sodium oxide, potassium oxide, rubidium oxide, and cesium oxide. A more detailed discussion of this ceramic composition, and methods for making it, is found in Gupta et al, U.S. Pat. No. 4,460,497, the disclosure of which has been incorporated by reference.

The circuit shown in FIG. 1 utilizes the nonlinear voltage/current characteristics of the ceramic composition to protect the electrical device 30. If the voltage level in the circuit reaches a certain predetermined level, which is designed to coincide with the breakdown region of nonlinear resistor 10, the current passed through the portion of the circuit containing nonlinear resistor 10 can increase by several orders of magnitude, effectively dumping the excess current through that portion of the circuit and protecting electrical device 30 from a voltage overload.

Figure 2:
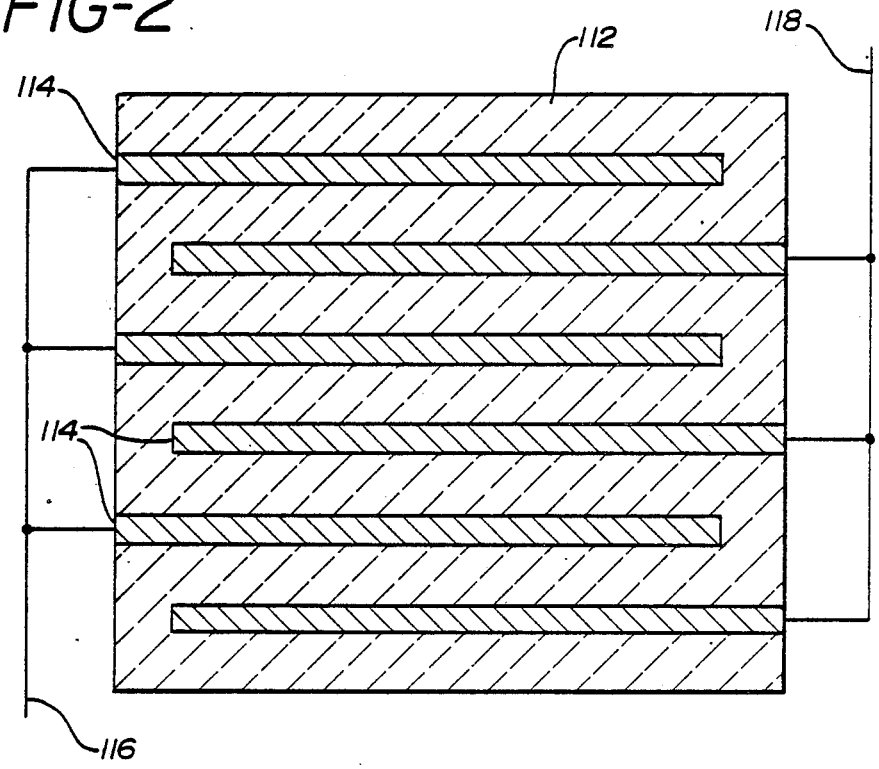
FIG. 2 is a greatly enlarged side view, in cross section, of the multilayer embodiment of the nonlinear resistor of the present invention.

A preferred construction of nonlinear resistor 10 is illustrated in FIG. 2. As shown, multiple alternating layers of metal electrodes 114 and ceramic composition 112 are stacked together and are electrically connected in parallel through electrical connectors 116 and 118. Although illustrated as having relatively few layers, devices having up to 50 to 100 alternating layers of electrodes and ceramic are contemplated by the invention. Such multilayer capacitor-type devices can be fabricated readily utilizing tape casting techniques known in the art. "Tape casting" refers to the known procedures for forming a multilayered body having appropriate metal electrodes interdispersed between ceramic layers.

Such ceramic layers may be formed by mixing powdered ceramic material with an appropriate organic binder and preparing a thin film sheet. The sheets may be stacked and pressed in a known manner followed by binder burnout and sintering. For a typical procedure, the appropriate proportions of ceramic powders are cast into sheets about 0.002 to about 0.02 cm thick using any one of several commercially available organic binders. After stacking with appropriate silk-screened electrode patterns, the stacks are pressed and fired to burn out the organic binder. The stack is then sintered at temperatures around 1000° C. Optionally, the stack may then be annealed at approximately 600° C. for a period of 1-3 hours to produce a composition having more electrically stable grain boundaries.

The final nonlinear resistor structure has alternating layers of electrodes and ceramic having generally flat parallel surfaces. For a typical application, the multilayer nonlinear resistor of the present invention will have square major faces of lengths between about 2 to about 7 cm. The overall thickness of the resistor will be about 0.1 to about 0.6 cm, with individual ceramic layers having thicknesses of about 0.002 to about 0.02 cm. Such a resistor is much smaller than the large (approximately 3 inch diameter) diodes currently used in quench protection circuits for superconducting magnets. Additionally, the flat, thin layer design of the resistor aids in dissipating heat buildup.

In order that the invention may be more readily understood, reference is made to the following example, which is intended to illustrate the invention but is not to be taken as limiting the scope thereof.

EXAMPLE

A zinc oxide-based ceramic having a composition substantially the same as the composition of Example 1 of Gupta et al, U.S. Pat. No. 4,460,497 was formed into a flat plate approximately 0.2 cm thick and having a cross-sectional area of approximately 0.34 $cm^2$. Its electrical properties were tested at 4.2 K. (liquid helium temperature), 77 K. (liquid nitrogen temperature), and 298 K. (room temperature).

Figure 3:
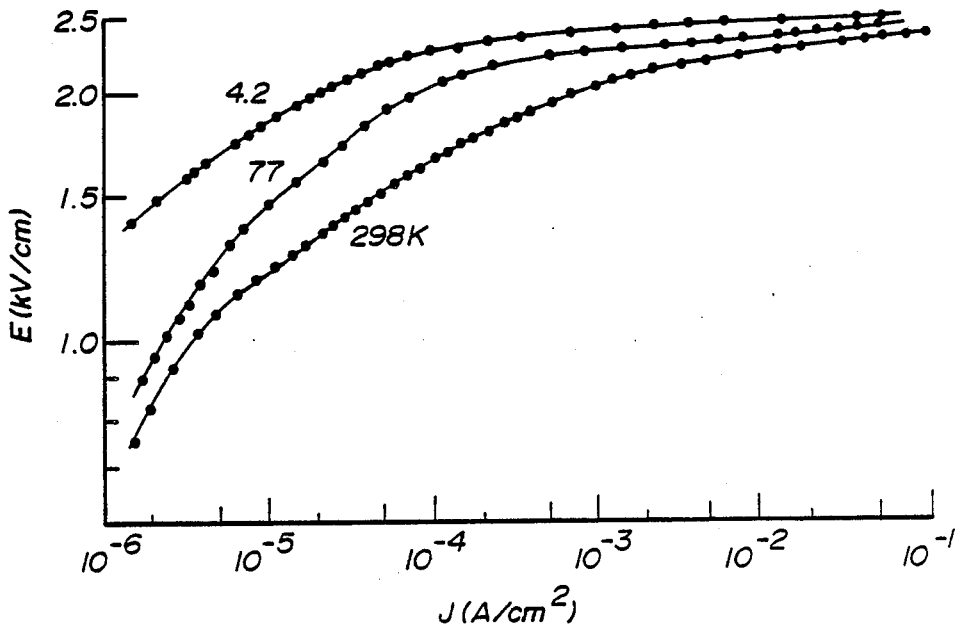
FIG. 3 is a graph of electric field strength (kV/cm) versus current density ($A/cm^2$) for the ceramic composition of the present invention measured at 4.2 K., 77 K., and 298 K., respectively.

The graph of FIG. 3 shows the behavior of the composition at these three temperatures. As can be seen, the composition possesses nonlinear voltage/current characteristics down to at least 4.2 K. The breakdown voltage of the composition is essentially independent of temperature in general, and shows a very small temperature dependence in the insulating prebreakdown region. This is in sharp contrast to an earlier study performed on a different zinc oxide-based ceramic composition which determined a strong temperature dependence for that composition in the breakdown region around room temperature. Sec H. R. Philipp and L. M. Levinson, J. Appl. Phys. 48, 1621 (1977).

The electrical properties of the zinc oxide-based ceramic composition were also measured using a curve tracer device at different temperatures and in the presence of intense magnetic fields under varying voltage and current conditions. The curve tracer measurements were carried out on a flat plate of the ceramic (0.2 cm thick, 0.34 $cm^2$ in cross sectional area). The flat plate had evaporated nichrome-gold electrodes applied to the major faces, and thin (approx. $5\times10^{-3}$ cm) copper leads were attached to the major faces with air-dry silver.

The curve tracer was a Tektronix Model 576 with associated camera. The ceramic sample was pulsed manually with the camera shutter open (approx. 0.2–0.3 sec), and the voltage/current characteristics were taken directly from the photographs. Power densities were estimated from the equation:

$$P=EJ \qquad \text{(Eq. I)}$$

where P is power density in watts, E is electrice field strength in volts/cm, and J is current density in amps/$cm^2$. Power densities were taken at two points on each trace: (1) $P_k$ was designated as the "knee" of the trace which was arbitrarily defined as the point at which the slope of the current versus voltage curve was 45°; and (2) $P_l$ was arbitrarily selected from a current density and field strength which were common to all traces.

Effective resistivities were also estimated from the equation:

$$\rho=(\Delta J/\Delta E)-1, \qquad \text{(Eq. II)}$$

where $\rho$ is the effective resistivity in ohm-cm, $\Delta J$ is the change in current density in amps/$cm^2$, and $\Delta E$ is the change in electric field strength in volts/cm.

The measurements in magnetic fields were performed in 15 tesla superconducting magnets. The electroded ceramic sample was wired into a Teflon (trademark) fixture attached to a long stainless steel tube for positioning the sample at the magnet centerline. Uncertainty in the magnetic field was approximately ±0.25% of full scale. The probe arrangement was inserted into the helium insert dewar of the magnet, and the system was vented to avoid pressure buildup in the dewar. The total lead resistance of this probe system was approximately 1 ohm, and the ceramic sample was located at the magnet centerline.

The results of the tracer studies are reported in Table I below.

TABLE I

| Temperature (K) | (Magnetic Field Strength)$^2$ (teslas$^2$) | $P_k$ (watts/$cm^3$) | $P_l$ (watts/$cm^3$) | (ohm · cm) |
|---|---|---|---|---|
| 298 | 0 | 0.415 | 7.11 | $2.27\times10^4$ |
| 77 | 0 | 0.225 | 7.39 | $2.27\times10^4$ |
| 4.2 | 0 | 0.177 | 7.96 | $3.43\times10^4$ |
| 4.2 | 10 | 0.320 | 8.20 | $5.13\times10^4$ |
| 4.2 | 50 | 0.379 | 8.11 | $4.20\times10^4$ |
| 4.2 | 100 | 0.450 | 8.01 | $3.43\times10^4$ |

The data in Table I show that the nonlinear voltage/current characteristics of the ceramic composition are not greatly affected by either temperature or intense magnetic fields.

Having described the invention in detail and by reference to preferred embodiments thereof, it will be apparent that modifications and variations are possible without departing from the scope of the invention defined in the appended claims.

What is claimed is:

1. A sintered multilayer capacitor-type resistor having nonlinear voltage/current characteristics at temperatures below room temperature down to about 4 K. comprising, a plurality of alternating layers of (a) a metal electrode and (b) a ceramic composition of matter comprising at least about 90 mole % of zinc oxide and up to about 10 mole % of additional metal oxides effective to provide electrical nonlinearity within the composition and including the combination of from about 0.002 mole % to about 0.02 mole % of aluminum oxide and a total amount of from about 0.003 mole % of about 0.2 mole % of at least one alkali metal oxide selected from the group consisting of sodium oxide, potassium oxide, rubidium oxide, and cesium oxide, and wherein said plurality of alternating layers are electrically connected in parallel.

2. The multilayer resistor of claim 1 in which the thickness of a layer of ceramic is between about 0.002 to about 0.02 cm.

3. The multilayer resistor of claim 1 in which there are between 50 to 100 alternating layers.

4. The multilayer resistor of claim 1 in which said alternating layers have generally flat parallel surfaces.

5. The multilayer resistor of claim 4 in which the overall thickness of said resistor is between about 0.1 to about 0.6 cm.

6. The multilayer resistor of claim 4 in which the major faces of said alternating layers are square and have lengths between about 2 to about 7 cm.

7. An electrical device operating in the temperature range of from below room temperature down to about 4 K. and having an electrical circuit designed to prevent a rise in voltage in the circuit above a predetermined level, said electrical circuit including a resistor having nonlinear voltage/current characteristics within said temperature range, said resistor comprising a ceramic composition of matter containing at least about 90 mole % of zinc oxide and up to about 10 mole % of additional metal oxides effective to provide electrical nonlinearity within the composition and including the combination of from about 0.002 mole % to about 0.02 mole % of aluminum oxide and a total amount of from about 0.003 mole % to about 0.2 mole % of at least one alkali metal oxide selected from the group consisting of sodium oxide, potassium oxide, rubidium oxide, and cesium oxide.

8. The electrical device of claim 7 in which said resistor has a plurality of alternating layers of a metal electrode and said ceramic composition and wherein said plurality of alternating layers are electrically connected in parallel.

9. The electrical device of claim 8 in which said resistor has between 50 to 100 alternating layers.

10. The electrical device of claim 8 in which individual layers of said ceramic composition are between about 0.002 to about 0.02 cm thick.

11. A method of preventing a rise in voltage above a predetermined level in an electrical device operating in the temperature range of from below room temperature down to about 4 K. comprising electrically connecting a resistor having nonlinear voltage/current characteristics at temperatures below room temperature down to about 4 K. in parallel to an electrical circuit containing an electrical device to be protected, said resistor comprising a ceramic composition of matter containing at least about 90 mole % of zinc oxide and up to about 10 mole % of additional metal oxides effective to provide electrical nonlinearity within the composition and including the combination of from about 0.002 mole % to about 0.02 mole % of aluminum oxide and a total amount of from about 0.003 mole % to about 0.2 mole % of least one alkali metal oxide selected from the group consisting of sodium oxide, potassium oxide, rubidium oxide, and cesium oxide, and operating said electrical device, whereby when said voltage rises to a predetermined level, said resistor passes sufficient electric current to prevent the voltage in said circuit from exceeding said predetermined level.

12. The electrical device of claim 7 in which said device includes a superconducting magnet, and said electrical circuit protects said superconducting magnet from voltage surges and transients.

13. The electrical device of claim 12 in which said resistor is substantially unaffected by the magnetic field produced by said superconducting magnet.

14. The method of claim 11 in which said electrical device includes a superconducting magnet.

15. The method of claim 14 in which said resistor is substantially unaffected by the magnetic field produced by said superconducting magnet.

16. The multilayer resistor of claim 1 in which said nonlinear voltage/current characteristics are exhibited at liquid oxygen, nitrogen, air and methane temperatures.

17. The electrical device of claim 7 operating at liquid oxygen, nitrogen, air, or methane temperatures.

18. The method of claim 11 in which said electrical device is operated at liquid nitrogen, oxygen, air, or methane temperatures.

* * * * *